US012546067B2

(12) United States Patent
Tokubi

(10) Patent No.: US 12,546,067 B2
(45) Date of Patent: Feb. 10, 2026

(54) WORK MACHINE

(71) Applicant: HONDA MOTOR CO., LTD., Tokyo (JP)

(72) Inventor: Kota Tokubi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 784 days.

(21) Appl. No.: 17/894,111

(22) Filed: Aug. 23, 2022

(65) Prior Publication Data

US 2024/0068178 A1 Feb. 29, 2024

(51) Int. Cl.
*E01C 19/42* (2006.01)
*E04F 21/24* (2006.01)

(52) U.S. Cl.
CPC ..... *E01C 19/42* (2013.01); *E04F 21/248* (2013.01)

(58) Field of Classification Search
CPC ..... E01C 19/22; E01C 19/42; E04F 21/245; E04F 21/247; E04F 21/248
USPC ..... 404/112
See application file for complete search history.

(56) References Cited

U.S. PATENT DOCUMENTS 5,372,452 A * 12/1994 Hodgson ..... E04F 21/248 404/112
6,264,397 B1 * 7/2001 Majewski ..... E04F 21/248 404/112
2005/0220541 A1 * 10/2005 Corbitt ..... E04F 21/245 404/112
2019/0341826 A1 * 11/2019 Zeiler ..... H02K 5/16
2020/0072291 A1 * 3/2020 Pyle ..... F16D 1/0894
2020/0318367 A1 * 10/2020 Rouillard ..... E04F 21/248
2021/0194316 A1 * 6/2021 Sprague ..... H02K 7/14
2022/0290448 A1 * 9/2022 Reed ..... E04F 21/248

FOREIGN PATENT DOCUMENTS

JP 3039124 U 7/1997

* cited by examiner

*Primary Examiner* — Raymond W Addie
(74) *Attorney, Agent, or Firm* — Thomas|Horstemeyer, LLP

(57) ABSTRACT

A work machine that smooths a road surface by rotating a blade contacting the road surface, the work machine comprises: a motor that rotates the blade; and a power supply device that includes a battery pack that supplies electric power to the motor, wherein the power supply device is disposed above the motor.

6 Claims, 7 Drawing Sheets

WORK MACHINE

BACKGROUND OF THE INVENTION

Field of the Invention

The present invention relates to a work machine that smooths a road surface by rotating blades contacting the road surface.

Description of the Related Art

Japanese Utility Model Registration No. 3039124 discloses a rechargeable rotary iron for leveling a concrete surface.

In recent years, in work machines for finishing a concrete surface, electrification has been promoted in order to reduce CO2 emission, and efficiency improvement of finishing work has been studied. For example, at the time of work using a work machine, a work machine having excellent work efficiency is desired from the viewpoint of visibility, ease of operation, and the like of a worker.

In view of the above problems, the present invention provides a work machine with excellent work efficiency.

SUMMARY OF THE INVENTION

According to one aspect of the present invention, there is provided a work machine that smooths a road surface by rotating a blade contacting the road surface, the work machine comprising: a motor that rotates the blade; and a power supply device that includes a battery pack that supplies electric power to the motor, wherein the power supply device is disposed above the motor.

According to the present invention, it is possible to provide a work machine with excellent work efficiency. By disposing the power supply device above the motor, a region where a worker can visually recognize the inside of the frame is enlarged, and visibility at the time of work can be improved.

The mass balance of the motor and the power supply device is uniform in the front-and-rear direction and the left-and-right direction centering on the rotation shaft of the motor. Thus, when the worker grips the handle, moves the handle in the front-and-rear direction, and swings the frame of the work machine in the XY plane, the frame can be easily swung in the XY plane in both the front-and-rear direction and the left-and-right direction in the XY plane.

BRIEF DESCRIPTION OF THE DRAWINGS

The accompanying drawings, which are incorporated in and constitute a part of the specification, illustrate embodiments of the invention and, together with the description, serve to explain principles of the invention.

DESCRIPTION OF THE EMBODIMENTS

Figure 1:
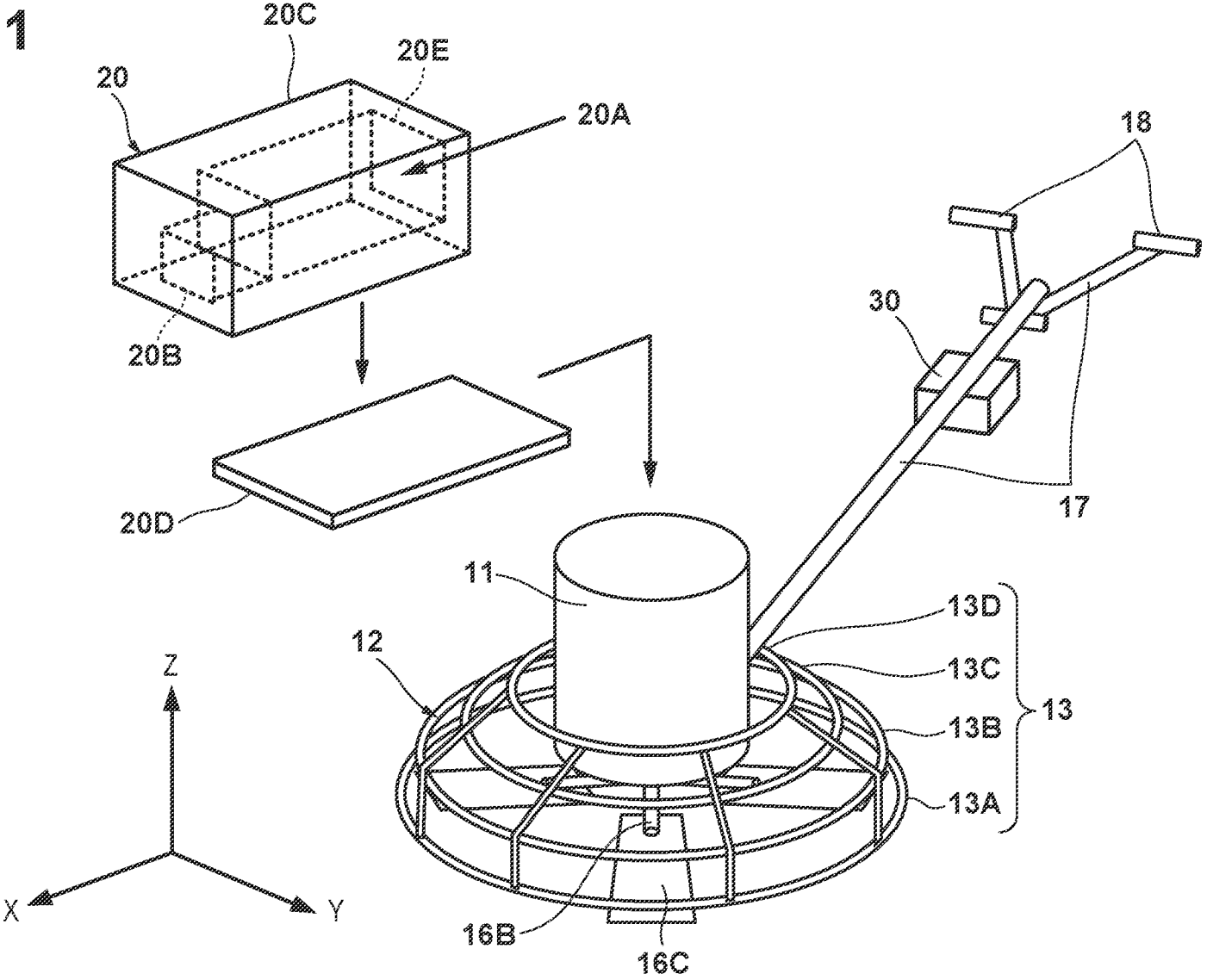
FIG. 1 is a perspective view illustrating a schematic configuration example of a finishing work machine according to an embodiment.

Hereinafter, embodiments will be described in detail with reference to the attached drawings. Note that the following embodiments are not intended to limit the scope of the claimed invention, and limitation is not made an invention that requires all combinations of features described in the embodiments. Two or more of the multiple features described in the embodiments may be combined as appropriate. Furthermore, the same reference numerals are given to the same or similar configurations, and redundant description thereof is omitted.

A finishing work machine 10 of an embodiment will be described. In the respective drawings described below, arrows X, Y, and Z indicate directions orthogonal to each other, an X direction indicates the front-and-rear direction of the finishing work machine 10, a Y direction indicates the left-and-right direction (width direction) of the finishing work machine 10, and a Z direction indicates the up-and-down direction of the finishing work machine 10. In the embodiment, the finishing work machine 10 will also be simply referred to as a work machine 10.

[Configuration Example of Finishing Work Machine]

Figure 2:
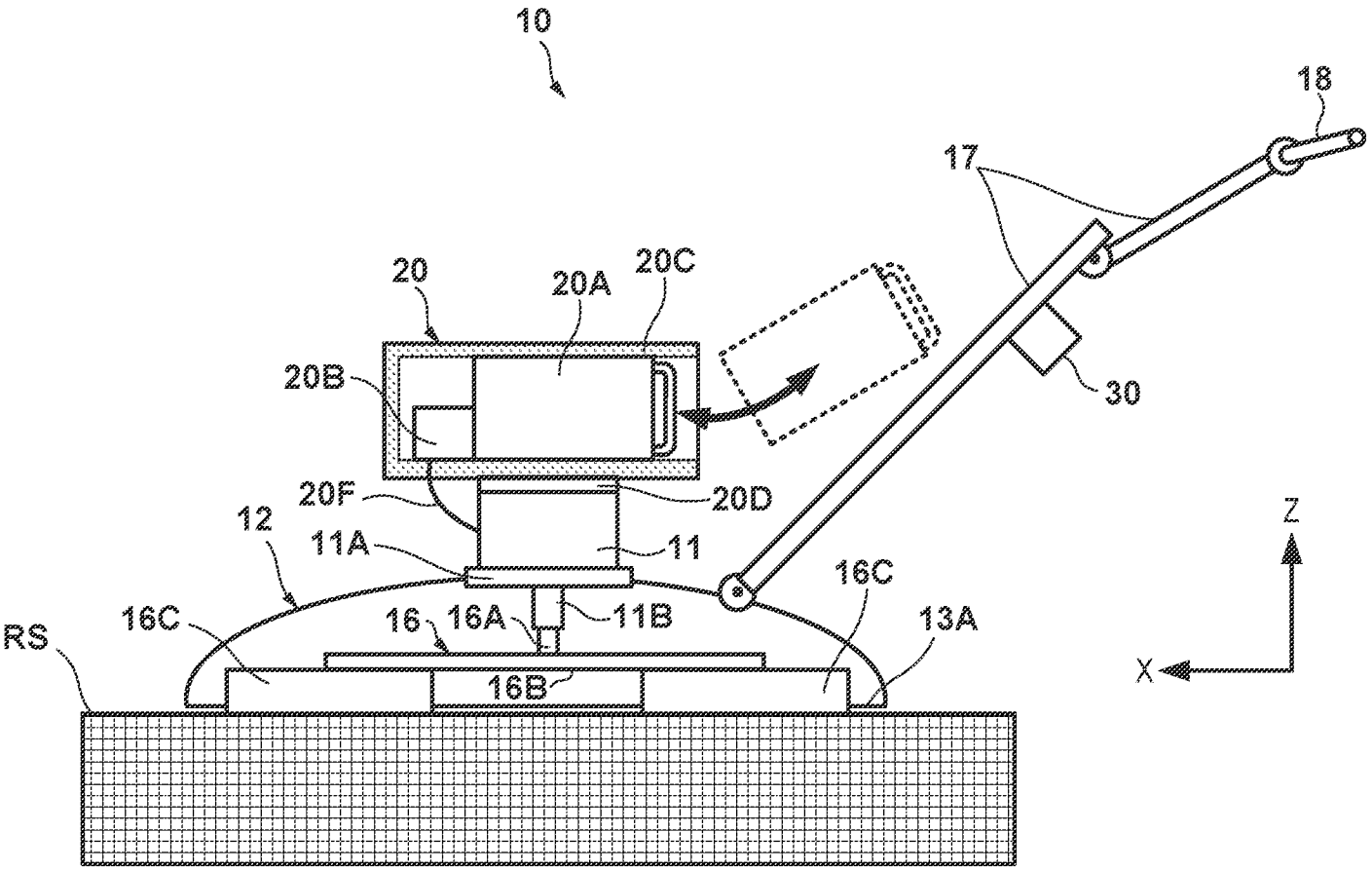
FIG. 2 is a side view schematically illustrating a configuration example (disposition example 1) of the finishing work machine on an XZ plane.
Figure 3:
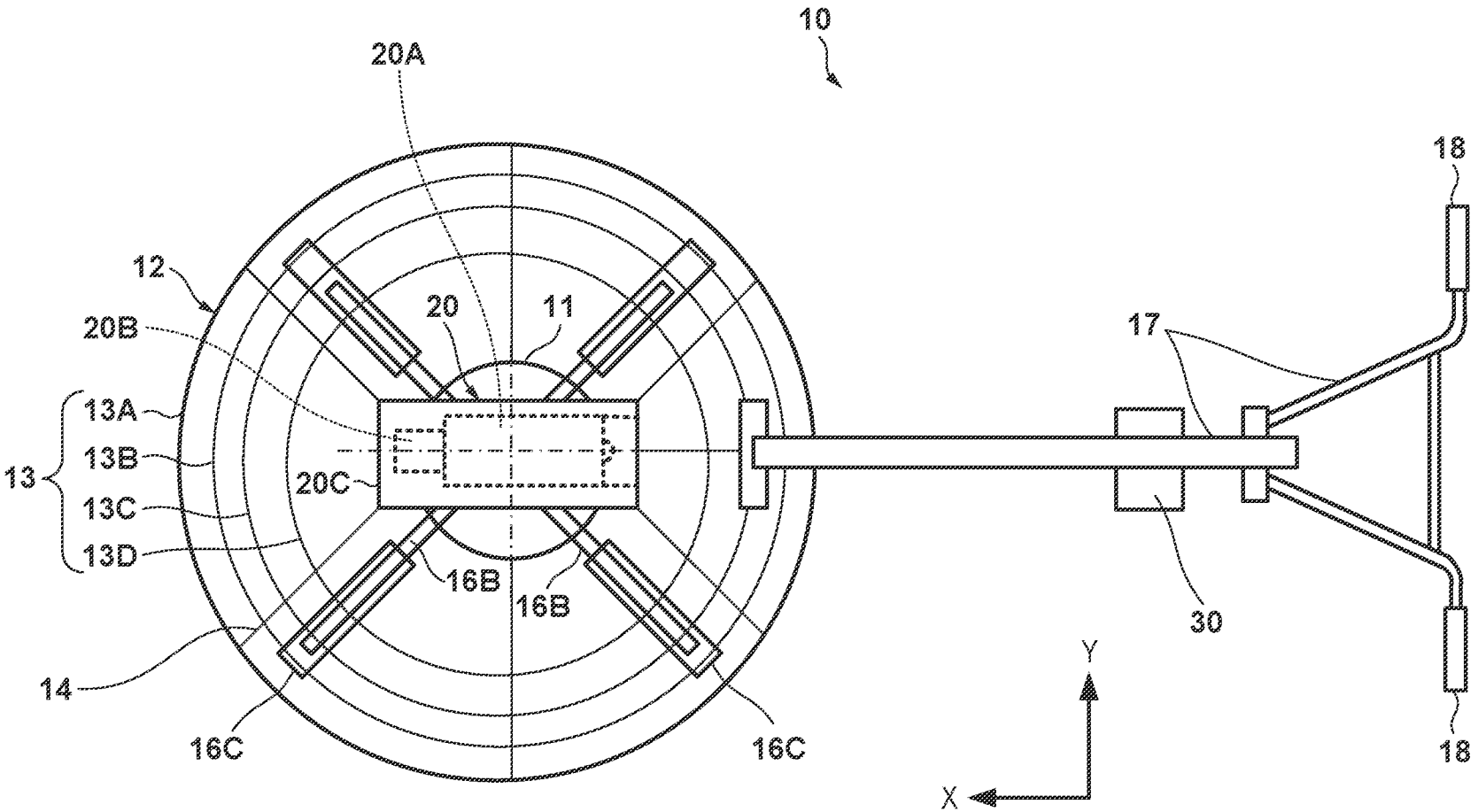
FIG. 3 is a top view schematically illustrating a configuration example of the finishing work machine on an XY plane.

FIG. 1 is a perspective view illustrating a schematic configuration example of the finishing work machine 10 according to an embodiment. FIG. 2 is a side view schematically illustrating a configuration example of the finishing work machine 10 on an XZ plane, and FIG. 3 is a top view schematically illustrating a configuration example of the finishing work machine 10 on an XY plane.

The finishing work machine 10 of the present embodiment is a finishing work machine that smooths a road surface RS by rotating blades 16C contacting the road surface RS. For example, at a construction site or the like, the finishing work machine 10 presses (contacts) the blades 16C (iron) on the road surface RS of concrete in an uncured state after the concrete is poured while rotating the blades 16C, and thus smooths the road surface RS. Work of smoothing the road surface RS of the concrete is referred to as finishing work, and the finishing work machine 10 of the present embodiment may be referred to as, for example, a trowel.

The finishing work machine 10 (trowel) includes a motor 11, a frame 12 (13, 14), a blade unit 16 (16A, 16B, 16C), an operation member 17, a power supply device 20, and a controller 30 (control device).

The operation member 17 is a shaft-shaped member extending obliquely upward in the Z direction from the frame 12. A handle 18 is formed at a distal end portion of the operation member 17 to be gripped by a worker. When the worker grips the handle 18 and moves the handle 18 in the front-and-rear direction, a force corresponding to movement (handle operation) of the handle 18 by the worker is transmitted to the frame 12 via the operation member 17. The worker performs a handle operation to move the road surface RS of the concrete while swinging the frame 12 of the finishing work machine 10 in the XY plane.

The finishing work machine 10 of the present embodiment includes a motor 11 that rotates the blades 16C, and a power supply device 20 having the battery pack 20A that supplies electric power to the motor 11. Here, the power supply device 20 is disposed above the motor 11.

As illustrated in FIG. 2, the motor 11 is held by a motor holding member 11A provided on an upper portion of the frame 12, and the power supply device 20 is disposed above the motor 11. The motor holding member 11A is not illustrated in FIG. 1 for better understanding of the configuration of the finishing work machine 10. An upper end side of the motor holding member 11A is connected to an outer periphery of the motor 11, and a lower end side of the motor holding member 11A is connected to the frame 12. The motor 11 is held by the frame 12 via the motor holding member 11A. The motor 11 is held by the frame 12 with a rotation shaft 11B facing downward in the Z direction (vertically downward).

The rotation shaft 11B of the motor 11 is rotated by the power supplied from the power supply device 20. A shaft 16A (rotation shaft) of the blade unit 16 is connected to the rotation shaft 11B of the motor 11, and a blade support arm 16B and the blades 16C are rotated according to rotation of the shaft 16A. The frame 12 of the finishing work machine 10 is swung in the XY plane by the worker's handle operation, and the unevenness of the road surface RS in the Z direction is leveled due to the rotation of the blades 16C contacting the road surface RS.

The frame 12 includes a plurality of annular rings 13 (13A, 13B, 13C, 13D) and a plurality of ring support arms 14. In FIG. 2, the annular rings 13B, 13C, and 13D and the plurality of ring support arms 14 are not illustrated for better understanding of the configuration of the finishing work machine 10. The plurality of annular rings 13 (13A, 13B, 13C, 13D) respectively have different diameters. Among the plurality of annular rings 13, the annular ring 13A disposed on the outermost circumference has the largest diameter, and the annular ring 13D disposed on the innermost circumference has the smallest diameter.

The annular ring 13B has a smaller diameter than that of the annular ring 13A, and is disposed on the inner circumferential side and the upper side with respect to the annular ring 13A. The annular ring 13C has a smaller diameter than that of the annular ring 13B, and is disposed on the inner circumferential side and the upper side with respect to the annular ring 13B. The annular ring 13D has a smaller diameter than that of the annular ring 13C, and is disposed on the inner circumferential side and the upper side with respect to the annular ring 13C.

The plurality of ring support arms 14 support the plurality of annular rings 13 (13A, 13B, 13C, 13D) in the vertical direction (Z direction). The plurality of ring support arms 14 support the annular rings at different positions in the vertical direction. The plurality of ring support arms 14 support the annular ring 13B at a position higher than the annular ring 13A in the vertical direction, support the annular ring 13C at a position higher than the annular ring 13B in the vertical direction, and support the annular ring 13D at a position higher than the annular ring 13C in the vertical direction.

The motor 11 is held by the motor holding member 11A formed at the upper end of the frame 12, and the blade unit 16 is disposed inside the frame 12. The blade unit 16 includes the shaft 16A, the plurality of blade support arms 16B, and the plurality of blades 16C. The shaft 16A extends upward in the Z direction (vertically upward) with respect to the XY plane and is connected to the rotation shaft 11B of the motor 11. The shaft 16A is rotated by receiving torque provided from the rotation shaft 11B of the motor 11. The plurality of blade support arms 16B are provided in a direction (orthogonal direction) intersecting with an axial direction (Z direction) of the shaft 16A, and the blades 16C are respectively attached to the blade support arms 16B.

As illustrated in FIG. 1, the plurality of blade support arms 16B are provided on the shaft 16A at equal intervals. For example, in a case where there are four blade support arms 16B, the blade support arms 16B are provided on the shaft 16A at intervals of 90 degrees. The lower end side of the blade 16C contacts the road surface RS, and the upper end side of the blades 16C is configured to be easily attachable to and detachable from the blade support arm 16B. Consequently, the blade 16C worn due to the contact with the road surface can be easily replaced. A blade angle of the blade 16C may also be adjusted via an attachment member (not illustrated). Here, the blade angle is an angle on an acute angle side between the road surface RS of the concrete and the blade 16C.

The motor 11 is, for example, a servomotor capable of performing rotation control, and functions as a drive source for rotating the blade unit 16 in the finishing work machine 10. The motor 11 includes a stator and a rotor (not illustrated), and generates power (rotational force) for rotating the rotor and the rotation shaft 11B by energizing a coil provided on one of the stator and the rotor. In the present embodiment, the motor 11 is held by the frame 12 via the motor holding member 11A such that the rotation shaft 11B faces downward in the Z direction.

The shaft 16A (rotation shaft) of the blade unit 16 is connected to the rotation shaft 11B of the motor 11. The blade support arm 16B and the blades 16C are rotated due to the rotation of the shaft 16A connected to the rotation shaft 11B of the motor 11. The lower end side of the blade 16C is in contact with the road surface RS, and the unevenness of the road surface RS in the Z direction is leveled due to the rotation of the blades 16C in a state of being in contact with the road surface RS.

The controller 30 is a control device that controls driving of the motor 11, and includes a processor (CPU), a memory, and an interface, and is configured to be able to communicate with the power supply device 20 via the interface. When the worker inputs an operation via a switch (not illustrated), the controller 30 outputs a control signal corresponding to the input operation. For example, the worker can select an operation mode corresponding to the degree of finishing of the road surface RS of the concrete via the switch, and the controller 30 outputs a control signal corresponding to the operation mode selected by the worker to the motor 11 via a communication cable (not illustrated). The control signal is, for example, a rotational speed signal for controlling a rotational speed (rotational speed) of the motor 11, and the controller 30 outputs a control signal for controlling different rotational speeds according to operation modes. The controller 30 outputs a power control signal corresponding to the selected operation mode to a power conversion circuit 20B via a communication cable (not illustrated), and the power conversion circuit 20B controls power to be supplied to the motor 11 on the basis of the power control signal received from the controller 30.

In the finishing work machine 10 of the present embodiment, the power supply device 20 includes a casing 20C, the battery pack 20A, and the power conversion circuit 20B. The power conversion circuit 20B is a so-called inverter circuit, and converts a direct current supplied from the battery pack 20A into an alternating current for the motor 11. The power supply device 20 is electrically connected to the motor 11 via a cable 20F, and supplies an alternating current to the motor 11. The casing 20C of the power supply device 20 is disposed above the motor 11 via a power supply mounting member 20D having a rectangular parallelepiped shape as a schematic shape, for example. The casing 20C may be attached to the motor 11 without the power supply mounting member 20D interposed therebetween.

Figure 4A:
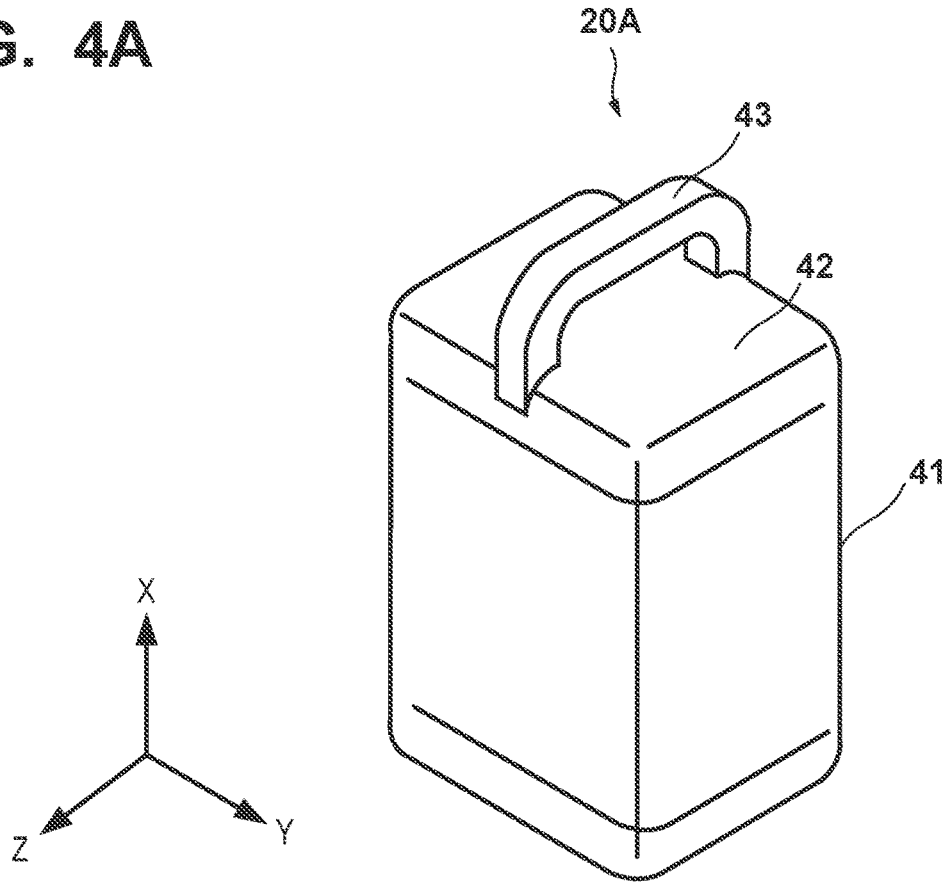
FIG. 4A is a top view of a battery pack.
Figure 4B:
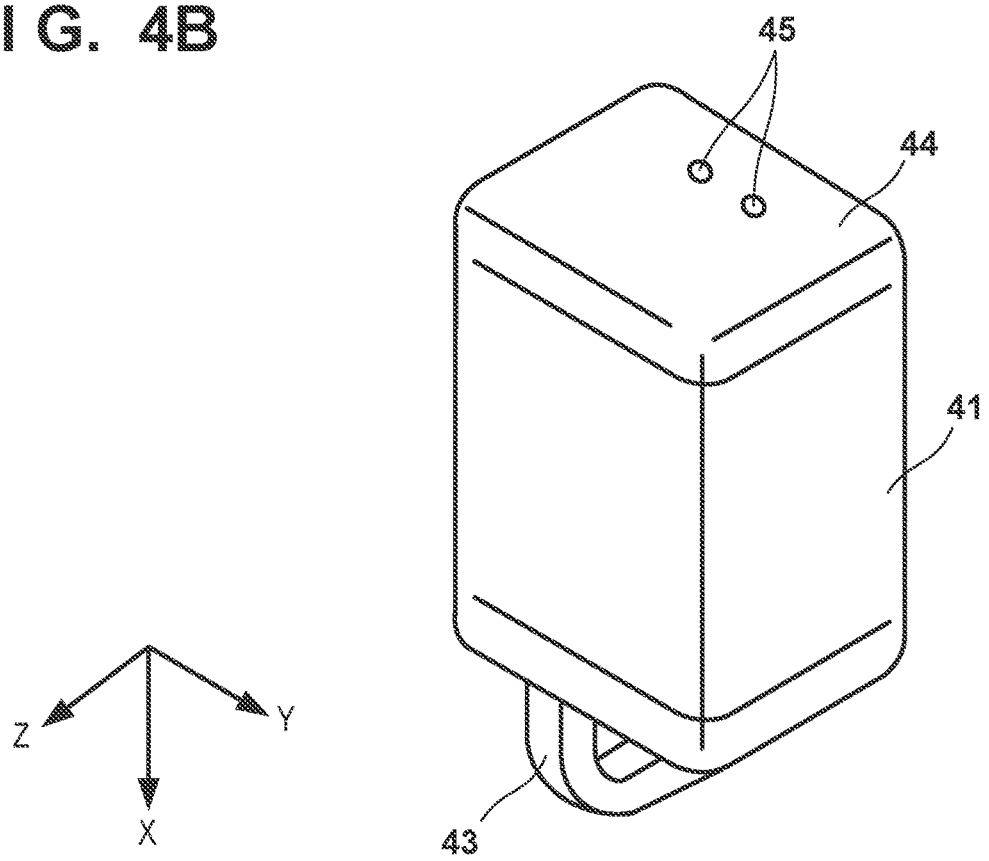
FIG. 4B is a bottom view of the battery pack.

FIGS. 4A and 4B are diagrams illustrating a schematic shape of the battery pack 20A that can be used in the finishing work machine 10 of the present embodiment, FIG. 4A is a diagram of the battery pack 20A viewed from an upper surface side, and FIG. 4B is a diagram of the battery pack 20A viewed from a lower surface side.

The battery pack 20A is a portable battery (mobile power pack: MPP) attachable to and detachable from the power supply device 20 (casing 20C), and as shown in FIGS. 4A and 4B, the battery pack 20A schematically includes a storage battery case 41 configured by a rectangular parallelepiped exterior body, and a battery group (not illustrated) as a power storage unit accommodated in the storage battery case 41. The battery group is preferably a lithium ion secondary battery, but is not particularly limited thereto, and for example, an all-solid-state battery or a secondary battery such as a nickel-metal hydride battery or a nickel-cadmium battery may be used.

In the finishing work machine 10 of the present embodiment, by using the detachable portable battery (MPP) as the configuration of the battery pack 20A, the finishing work can be continuously performed without waiting for the charging time by replacing a discharged portable battery (MPP) with a charged portable battery (MPP) without performing charging by connecting a power cable to the finishing work machine 10.

A handle 43 is provided on an upper surface 42 of the storage battery case 41. The handle 43 is gripped when the worker carries the battery pack 20A.

An opening 20E through which the battery pack 20A can be mounted to the casing 20C of the power supply device 20 and the battery pack 20A can be taken out from the casing 20C is formed on the casing surface of the power supply device 20 at a position close to the operation member 17 and the handle 18.

As illustrated in FIG. 1, an opening 20E is formed on a surface of the casing 20C of the power supply device 20 formed at a position close to the operation member 17 and the handle 18, and the worker can accommodate the battery pack 20A in the casing 20C through the opening 20E while gripping the handle 43. On the lower surface 44 of the battery pack 20A, an opening 45 into which an electrode probe of the power conversion circuit 20B can be inserted is formed. Inside the storage battery case 41, an electrode (not illustrated) connected to the battery group is provided. When the battery pack 20A is accommodated in the casing 20C and the battery pack 20A is inserted to the position of the power conversion circuit 20B, the electrode probe of the power conversion circuit 20B and the electrode of the battery group are connected to establish electrical connection. When replacing the battery pack 20A, the worker grips the handle 43 and pulls out the battery pack 20A to the opening 20E side, and thus the electrical connection between the electrode probe and the electrode is canceled and the battery pack 20A can be taken out from the casing 20C.

(Disposition Example 1 of Power Supply Device 20)

The battery pack 20A that can be accommodated in the power supply device has a rectangular parallelepiped exterior structure as illustrated in FIGS. 4A and 4B. As a disposition example of the power supply device 20, for example, as illustrated in FIG. 2, the power supply device 20 is disposed above the motor 11 such that a longitudinal direction of the battery pack 20A is substantially orthogonal to the axial direction (Z direction) of the rotation shaft 11B of the motor 11 in a side view of the finishing work machine 10.

As illustrated in FIG. 3, the power supply device 20 (battery pack 20A) is disposed at a position overlapping the rotation center of the rotation shaft 11B of the motor 11 in a top view of the finishing work machine 10. That is, in a state in which the battery pack 20A is accommodated in the casing 20C of the power supply device 20, the battery pack 20A is disposed at a position where the center position of the battery pack 20A in the front-and-rear direction (X direction) and the center position thereof in the width direction (Y direction) overlap the rotation center of the motor 11.

Assuming that the mass balance is non-uniform in the disposition of the power supply device 20, partial contact occurs in the contact between the blades 16C and the road surface RS depending on a swing direction of the frame 12, frictional resistance from the road surface RS increases, and this may become a factor that hinders a smooth swing operation of the frame 12.

However, as illustrated in FIGS. 2 and 3, by disposing the power supply device 20 above the motor 11, the mass of the power supply device 20 accommodating the battery pack 20A can be concentrated on the rotation shaft of the motor 11. The mass balance of the motor 11 and the power supply device 20 is uniform in the front-and-rear direction and the left-and-right direction centering on the rotation shaft of the motor 11.

Thus, when the worker grips the handle 18, moves the handle 18 in the front-and-rear direction, and swings the frame 12 of the finishing work machine 10 in the XY plane, the frame 12 can be easily swung in the XY plane in both the front-and-rear direction and the left-and-right direction in the XY plane.

By making the mass balance uniform in the front-and-rear direction and the left-and-right direction centering on the rotation shaft of the motor 11, partial contact between the blades 16C and the road surface RS is suppressed, and the life of the blades 16C can be extended.

In a case where power supply devices are disposed to be arranged on the side of the motor 11, the power supply devices block the inside of the frame 12. Therefore, there may be a case where it is difficult for the worker to visually recognize a finished state of the road surface RS in the operation state of gripping the handle 18. By disposing the power supply device 20 above the motor 11 as in the disposition example 1, a region where the worker can visually recognize the inside of the frame 12 is enlarged, and visibility at the time of finishing work can be improved.

The position on the rear side of the casing 20C is a position close to the operation member 17 and the handle 18, and is a position that can be easily accessed by the worker from the handle 18 side when the battery pack 20A is mounted in the casing 20C or the battery pack 20A is replaced. As in the disposition example 1, by disposing the power supply device 20 above the motor 11 and providing the opening 20E of the casing 20C on the rear side of the casing 20C, it is possible to improve ease of mounting or replacement of the battery pack 20A.

(Disposition Example 2 of Power Supply Device 20)

Figure 5:
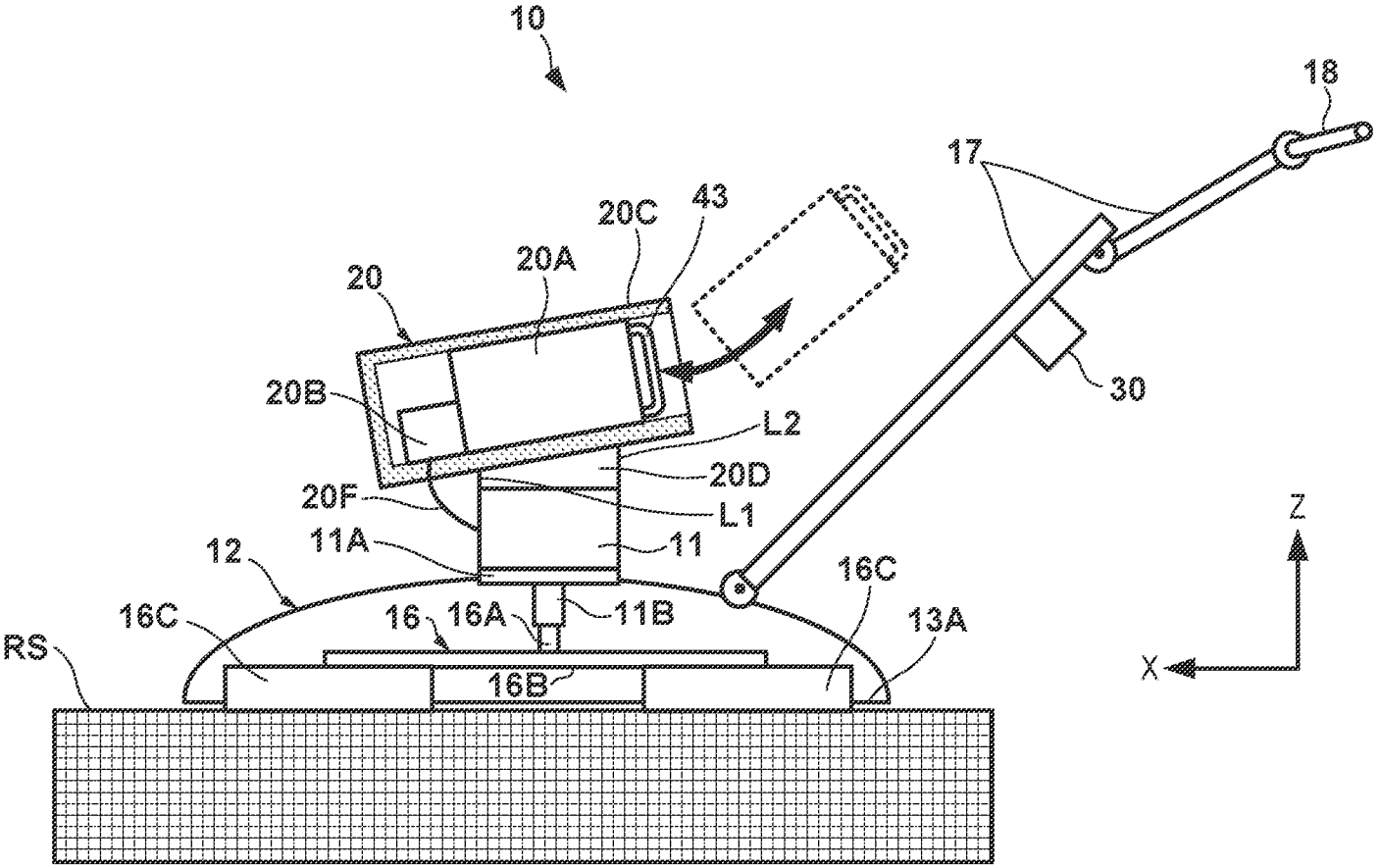
FIG. 5 is a side view schematically illustrating a configuration example (disposition example 2) of the finishing work machine on the XZ plane.

In the disposition example 1, the example in which the power supply device 20 is disposed above the motor 11 in a state in which the longitudinal direction of the exterior structure is substantially orthogonal to the axial direction (Z direction) of the rotation shaft 11B of the motor 11 has been described. However, for example, as illustrated in FIG. 5, the power supply device 20 may be disposed to be inclined with respect to the axial direction of the rotation shaft 11B of the motor 11 in a side view of the finishing work machine 10. That is, in a side view of the finishing work machine 10, the power supply device 20 may be disposed above the motor 11 in a state in which the rear side of the casing 20C of the power supply device 20 is inclined upward compared with the front side of the casing 20C.

In the disposition in the inclined state, for example, as illustrated in FIG. 5, a sectional structure of the power supply mounting member 20D may be trapezoidal in a side view. In the example illustrated in FIG. 5, as a sectional structure of the power supply mounting member 20D, a member height (thickness) on the front side of the casing 20C may be L1, a member height (thickness) on the rear side of the casing 20C may be L2 larger (thicker) than L1, and the power supply device 20 may be disposed to be inclined with respect to the direction of the rotation shaft 11B of the motor 11 via the power supply mounting member 20D. The sectional structure of the power supply mounting member 20D is exemplary, and is not limited to a trapezoid and may be a triangular sectional structure as long as the rear side is higher than the front side. A structure corresponding to the sectional structure of the power supply mounting member 20D may be formed in the structure of the casing 20C without using the power supply mounting member 20D.

As in the disposition example 2, by disposing the power supply device 20 in a state in which the casing 20C is inclined, the position of the center of gravity in the motor 11 and the power supply device 20 can be lowered, and it is possible to improve the ease of mounting or replacement of the battery pack 20A by the worker. Since the rear side of the casing 20C is inclined upward compared with the front side of the casing 20C, the worker can work without bending when mounting or replacing the battery pack 20A. Consequently, a burden on the worker can be reduced, and the ease of mounting or replacement can be improved.

(Disposition Example 3 of Power Supply Device 20)

Figure 6:
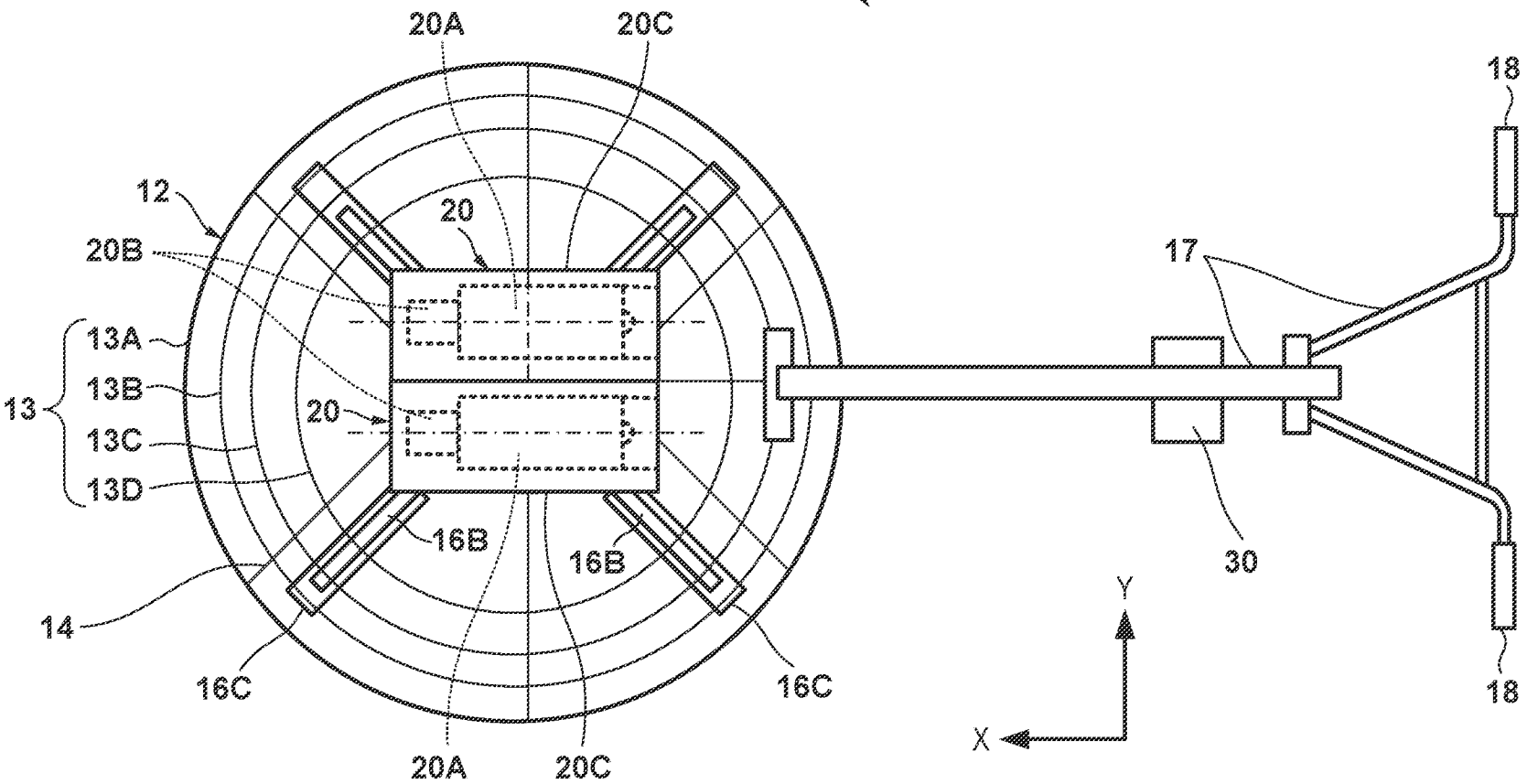
FIG. 6 is a top view schematically illustrating a configuration example (disposition example 3) of the finishing work machine on an XY plane.

In the disposition example 1 and the disposition example 2, an example in which one power supply device 20 (battery pack 20A) is disposed above the motor 11 has been described, but a plurality of power supply devices 20 may be disposed above the motor 11. For example, as illustrated in FIG. 6, the power supply devices 20 may be arranged horizontally and disposed above the motor 11 in a top view (in an XY plane) of the finishing work machine 10. In the disposition example in FIG. 6, in a state in which the battery pack 20A is accommodated in the casing 20C of the power supply device 20, the battery pack 20A is disposed at a position where the center position of the two battery packs 20A in the front-and-rear direction (X direction) and the center position thereof in the width direction (Y direction) overlap the rotation center of the motor 11.

Figure 7:
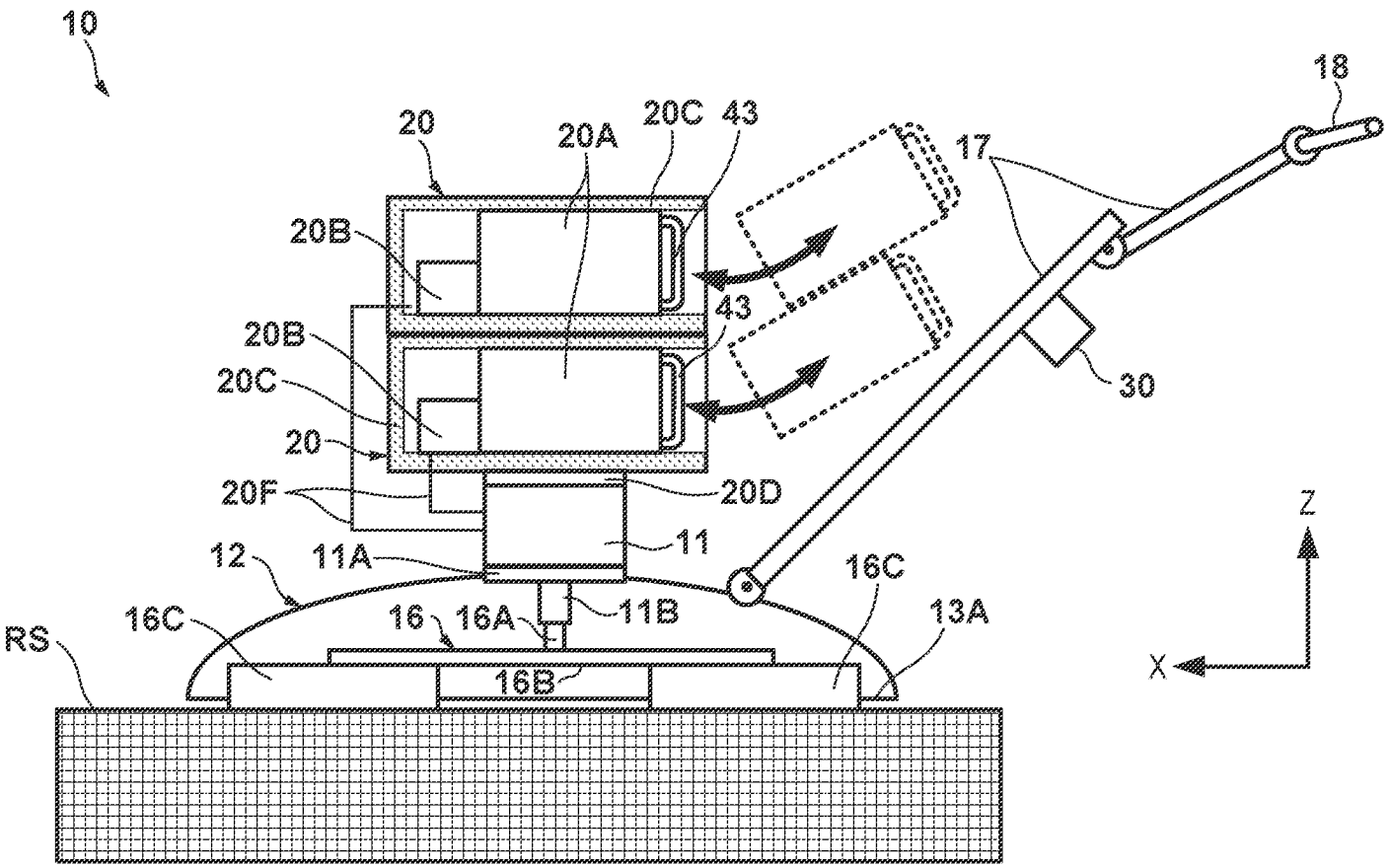
FIG. 7 is a side view schematically illustrating a configuration example (disposition example 3) of the finishing work machine on the XZ plane.

As illustrated in FIG. 7, the power supply devices 20 may be arranged in the vertical direction intersecting the XY plane and disposed above the motor 11 in a side view (in the XZ plane) of the finishing work machine 10. FIGS. 6 and 7 illustrate disposition examples of two power supply devices 20 as a disposition example of the plurality of power supply devices 20, but the number of power supply devices 20 may be two or more. In FIGS. 6 and 7, a configuration example has been described in which the battery pack 20A is accommodated in the casing 20C of the power supply device 20 in a state in which the longitudinal direction of the exterior structure of the battery pack 20A is orthogonal to the axial direction of the rotation shaft 11B of the motor 11. However, the present invention is not limited to this configuration example. For example, as a disposition example of the plurality of power supply devices 20, as illustrated in FIG. 5, in a side view of the finishing work machine 10, the power supply device 20 may be disposed above the motor 11 in a state in which the rear side of the casing 20C is inclined upward compared with the front side of the casing 20C.

Since a plurality of types of work using various construction machines are performed in parallel at a construction site or the like, even in a case where charging of the battery pack 20A is required, charging of the battery pack 20A may be restricted. According to the configuration of the disposition example 3, the plurality of battery packs 20A can be mounted on the finishing work machine 10. Consequently, even in a case where continuous operation is performed for a long time, power from a plurality of power supply devices can be stably supplied to the motor 11. It is possible to smoothly perform finishing work even in a power supply environment in a construction site or the like.

SUMMARY OF EMBODIMENTS

1. The work machine of the above embodiment is a work machine 10 that smooths the road surface RS by rotating a blade 16C contacting the road surface RS, and includes:

the motor 11 that rotates the blade 16C; and the power supply device 20 that includes the battery pack 20A that supplies electric power to the motor 11, in which the power supply device 20 is disposed above the motor 11.

According to Configuration 1, it is possible to provide the work machine excellent in the work efficiency. By disposing the power supply device 20 above the motor 11, a region where a worker can visually recognize the inside of the frame 12 is enlarged, and visibility at the time of work can be improved.

The mass balance of the motor and the power supply device is uniform in the front-and-rear direction and the left-and-right direction centering on the rotation shaft of the motor. Thus, when the worker grips the handle, moves the handle in the front-and-rear direction, and swings the frame of the work machine in the XY plane, the frame can be easily swung in the XY plane in both the front-and-rear direction and the left-and-right direction in the XY plane.

2. In the above embodiment, the battery pack 20A has a rectangular parallelepiped exterior structure, and in a side view of the work machine 10, the battery pack 20A is accommodated in the casing 20C of the power supply device 20 in a state in which the longitudinal direction of the exterior structure is orthogonal to the axial direction of the rotation shaft 11B of the motor 11.

According to Configuration 2, it is possible to improve the ease of mounting or replacement of the battery pack 20A by the worker while lowering the center of gravity of the motor 11 and the power supply device 20.

3. In the above embodiment, in a side view of the work machine 10, the power supply device 20 is disposed above the motor 11 in a state in which the rear side of the casing 20C is inclined upward compared with the front side of the casing 20C.

According to Configuration 3, by disposing the power supply device 20 in a state in which the casing 20C is inclined, it is possible to improve the ease of mounting or replacement of the battery pack 20A by the worker while lowering the positions of the center of gravity of the motor 11 and the power supply device 20. Since the rear side of the casing 20C is inclined upward compared with the front side of the casing 20C, the worker can work without bending when mounting or replacing the battery pack 20A. Consequently, a burden on the worker can be reduced, and the ease of mounting or replacement can be improved.

4. In the above embodiment, the power supply device 20 is disposed at a position overlapping the rotation center of the rotation shaft 11B of the motor 11 in a top view of the work machine 10.

According to Configuration 4, the mass of the power supply device 20 accommodating the battery pack 20A can be concentrated on the rotation shaft of the motor 11. The mass balance of the motor 11 and the power supply device 20 is uniform in the front-and-rear direction and the left-and-right direction centering on the rotation shaft of the motor 11. Thus, when the worker grips the handle 18 and moves the handle 18 in the front-and-rear direction to swing the frame 12 of the work machine 10 in the XY plane, the frame 12 can be easily swung in the XY plane in both the front-and-rear direction and the left-and-right direction in the XY plane.

By making the mass balance uniform in the front-and-rear direction and the left-and-right direction centering on the rotation shaft of the motor 11, partial contact between the blades 16C and the road surface RS is suppressed, and the life of the blades 16C can be extended.

5. In the above embodiment, the work machine 10 further includes the frame 12 on which the motor 11 is disposed;

the shaft-like operation member 17 that extends from the frame 12 in a side view of the work machine 10; and the handle 18 that is formed at a distal end of the operation member 17 and grippable by the worker, in which the opening 20E, through which the battery pack 20A can be mounted to the casing 20C of the power supply device 20 and the battery pack 20A can be taken out from the casing 20C, is formed on the casing surface of the power supply device 20 at a position close to the operation member 17 and the handle 18.

The position on the rear side of the casing 20C is a position close to the operation member 17 and the handle 18, and is a position that can be easily accessed by the worker from the handle 18 side when the battery pack 20A is mounted in the casing 20C or when the battery pack 20A is taken out and replaced.

According to Configuration 5, since the power supply device 20 is disposed above the motor 11 and the opening 20E of the casing 20C is provided on the rear side of the casing 20C, it is possible to improve ease of mounting or replacement of the battery pack 20A.

6. In the above embodiment, the battery pack 20A is a portable battery MPP attachable to and detachable from the power supply device.

According to Configuration 6, by using the detachable portable battery (MPP) as a configuration of the battery pack 20A, it is possible to continuously perform work without waiting for a charging time by replacing a discharged portable battery with a charged portable battery without performing charging by connecting a power cable to the work machine 10.

The invention is not limited to the foregoing embodiments, and various variations/changes are possible within the spirit of the invention.

What is claimed is:

1. A work machine that smooths a road surface by rotating a blade contacting the road surface, the work machine comprising:

a motor that rotates the blade; and a plurality of power supply devices that each includes a battery pack that supplies electric power to the motor, wherein the plurality of power supply devices are disposed above the motor, and the battery pack mounted on each of the plurality of power supply devices is configured to be attachable to and detachable from the respective power supply device.

2. The work machine according to claim 1, wherein the battery pack has a rectangular parallelepiped exterior structure, and in a side view of the work machine, the battery pack is accommodated in a casing of the power supply device in a state in which a longitudinal direction of the exterior structure is orthogonal to an axial direction of a rotation shaft of the motor.

3. The work machine according to claim 2, wherein in the side view of the work machine, the power supply device is disposed above the motor in a state in which a rear side of the casing is inclined upward compared with a front side of the casing.

4. The work machine according to claim 1, wherein the power supply device is disposed at a position overlapping a rotation center of a rotation shaft of the motor in a top view of the work machine.

5. The work machine according to claim 1, further comprising:

a frame on which the motor is disposed;

a shaft-like operation member that extends from the frame in a side view of the work machine; and a handle that is formed at a distal end of the operation member and grippable by a worker, wherein an opening, through which the battery pack can be mounted in a casing of the power supply device and the battery pack can be taken out from the casing, is formed in a casing surface of the power supply device at a position close to the operation member and the handle.

6. The work machine according to claim 1, wherein the battery pack is a portable battery attachable to and detachable from the power supply device.

* * * * *